US006935292B2

(12) United States Patent
Spiegel et al.

(10) Patent No.: US 6,935,292 B2
(45) Date of Patent: Aug. 30, 2005

(54) CAMSHAFT WITH CURVATURE

(75) Inventors: Walter Spiegel, Satteins (AT); Peter Wiesner, Ludesch (AT); Manfred Muster, Bludesch (AT); Walter Schreiber, Schaanwald (LI)

(73) Assignee: Thyssenkrupp Presta AG, Eschen (LI)

( * ) Notice: Subject to any disclaimer, the term of this patent is extended or adjusted under 35 U.S.C. 154(b) by 0 days.

(21) Appl. No.: 10/093,592

(22) Filed: Mar. 8, 2002

(65) Prior Publication Data

US 2003/0097999 A1 May 29, 2003

(30) Foreign Application Priority Data

Nov. 27, 2001 (CH) ..... 2179/01

(51) Int. Cl.[7] ..... F01L 1/02

(52) U.S. Cl. ..... 123/90.27; 123/90.31; 123/90.6; 29/888.1

(58) Field of Search ..... 123/90.16, 90.27, 123/90.31, 90.6, 193.5, 193.3, 198 F, 90.34; 29/888.1, 523; 74/55, 567, 568 R

(56) References Cited

U.S. PATENT DOCUMENTS

| | | | | | |
|---|---|---|---|---|---|
| 1,527,456 | A | * | 2/1925 | Woydt et al. | 74/568 R |
| 4,293,995 | A | * | 10/1981 | Jordan | 29/421.1 |
| 4,597,365 | A | * | 7/1986 | Madaffer | 123/90.6 |
| 4,612,695 | A | * | 9/1986 | Umeha et al. | 29/505 |
| 4,660,269 | A | * | 4/1987 | Suzuki | 29/523 |
| 4,841,627 | A | * | 6/1989 | Arnold et al. | 29/720 |
| 4,993,282 | A | * | 2/1991 | Swars | 74/567 |
| 5,299,881 | A | * | 4/1994 | Mettler-Friedli | 403/274 |
| 5,429,574 | A | | 7/1995 | Murakami | 492/39 |
| 6,182,361 | B1 | * | 2/2001 | Cox et al. | 29/888.1 |

FOREIGN PATENT DOCUMENTS

| | | | | |
|---|---|---|---|---|
| DE | 3303629 | A * | 9/1983 | B21D/53/84 |
| DE | 3803683 | | 8/1989 | |
| DE | 3913844 | | 10/1990 | |
| DE | 19909184 | | 9/2000 | |
| EP | 340128 | A * | 11/1989 | B21K/25/00 |

* cited by examiner

*Primary Examiner*—Thomas Denion
*Assistant Examiner*—Ching Chang
(74) *Attorney, Agent, or Firm*—Notaro & Michalos PC

(57) ABSTRACT

Camshaft configurations are increasingly more closely assembled in motor vehicle engines such that access to the cylinder head bolts is obstructed. Indentations 2 along built-up camshafts, which comprise a camshaft tube 1 with slid-on camshaft structural components, such as the cams 3, permit through corresponding rotation free access to the cylinder head bolts even after they are in the installed state. In order to be able to employ for the camshaft structure tubular camshafts 1, according to the invention a pressing tool 10 with bottom dies 12, 13 is provided such that during the pressing operation of the indentations, the camshaft tube 1 advantageously is not deformed beyond the original outer diameter d and the camshaft 1 can be assembled advantageously form-fittingly through subsequent sliding-on of the cams 3.

17 Claims, 3 Drawing Sheets

CAMSHAFT WITH CURVATURE

FIELD AND BACKGROUND OF THE INVENTION

The invention relates to a camshaft, as well as to a method for producing a camshaft.

Camshafts for the control of internal combustion engines for motor vehicles are today installed in ever more compact configurations. For example, for reasons of saving space, camshafts are disposed pairwise in such proximity that direct access to the cylinder head bolts is no longer possible. In order to dismount the cylinder head or to tighten up cylinder head bolts, such camshafts must in these cases be first dismounted, which is not service-friendly and entails additional costs. In the case of solidly built-up camshafts one solution proposes to mill or grind a transversely disposed groove-shaped indentation in the proximity of the cylinder head bolts. It is also possible in the case of solidly cast camshafts to cast the indentations directly. In order to establish access to the cylinder head bolts, the camshafts can be rotated in this case such that the camshaft indentations expose the region of the cylinder head bolts.

However, for purposes of simplification and to save expenses, for some time camshafts have no longer been produced, such as cast, of one part, but rather are produced as so-called built-up camshafts, i.e. they are assembled from several parts. Such a built-up camshaft comprises a tube, onto which prefabricated cams are slid up to their position and fixed on the tube. In such a camshaft tube it is not possible to apply indentations in the known manner, for example by milling. Milling would weaken the camshaft tube in the proximity of the indentations to such an extent that the loading would not be tolerable during engine operation. If, for reinforcement of the milled-out indentations in the camshaft tube, a further tube or even a full shaft were to be pressed into the same, sufficient strength would still not be ensured in many cases and would reduce the weight advantages of built-up hollow camshafts, if not even completely negate them, and would cause additional costs.

SUMMARY OF THE INVENTION

The present invention addresses the problem of eliminating the disadvantages of the above described prior art. The task in particular comprises developing a camshaft as a tube and applying Into its tube walls convexities which, in the installed state, make possible access to the cylinder head bolts without losing the advantage of so-called built-up camshafts.

The task is solved according to the invention through the configuration according to the characteristics of the invention, as well as according to the production method of the invention.

The task is solved according to the invention in that for the production of indentations in a camshaft the wall in the selected region of a tubular camshaft is pressed in such that the desired notching is generated in a direction transversely to the camshaft axis. It is herein especially advantageous if, during the pressing operation, the generated deformation in the tube wall region does not lead to projection beyond the original outer diameter of the tube. This ensures that the cams can be slid to their position over the tube provided with the indentations and can be fixed there with the conventional mounting methods. The camshaft can be precisely assembled in known manner from the tube, cams and the further known components such as axial bearing ring, chain sprocket wheel, etc. in known manner precisely after the production of the pressed-in indentations to form a built-up camshaft.

As stated, it must be ensured that after the pressing operation the cams can be slid precisely over such and the tube. At the indentation the tube indenting should be narrow such that cams can also lie closely next to the indentations. The tube must not be weakened or only slightly so due to the necessary rigidity against bending and torquing. In the indentation the tube circumference is reduced up to 30%, with this material having to be displaced such that no protrusion is generated relative to the outer tube diameter. Moreover, the tube must not bend during the indentation process. In the production process a further intermediate process step between the generation of the indentation in the shaft and the mounting of the parts is undesirable. Intermediate steps such as over-grinding, turning etc. should be avoided thereby that the tube diameter is not increased or only insignificantly through the indentation process. The camshaft tube is held in a bottom die for generating the indentation form-fittingly at the site of the indentation to be generated, with this bottom die preferably being developed as a pretensioning frame. The bottom die has an opening in the proximity of the indentation to be generated, into which a pressing stamp is guided. With the pressing stamp the tube wall is deformed such that the desired indentation is generated in the tube wall. The precise encompassing holding of the tube in the bottom die leads to the fact that during the pressing operation the entire material displacement takes place into the wall thickness and not by way of a deformation toward the outside. With this process form-fitting indentations can be generated in simple and cost-effective manner utilizing the proven tubular camshaft structural technique known as built-up camshafts.

It is also possible to permit a projection of the original outer diameter in the proximity of the pressed-in indentation. Such deformation can amount to a few millimeters in the case of conventional camshaft dimensions. But, in this case, it must be ensured that such projections do not interfere with the remaining adjacent part of the engine aggregate during rotation of the shaft and make impossible the contacting or even a rotation. The projection should herein with advantage be maximally stamped out so far that it does not project into the running surface of the cam or is spaced somewhat apart from it. Should a projecting be permitted, it is possible to draw the cams over the tube before developing the indentation and to mount them at the site intended for this purpose and subsequently to apply the indentation on the tube. While this approach has advantages compared to prior art with milled-in indentation, it is, however, less favorable in fabrication sequences and requires greater expenditures in the production compared to the previously cited, preferred and more precise implementation without projections of the outer diameter of the tube.

BRIEF DESCRIPTION OF THE DRAWINGS

In the following the invention will be explained in further detail by example and with reference to schematic figures, in which.

DESCRIPTION OF THE PREFERRED EMBODIMENTS

Figure 1A:
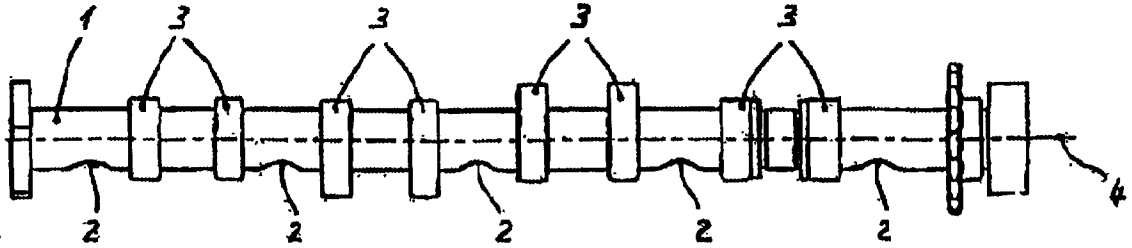
FIG. 1*a* is a schematic side view of an assembled tubular camshaft with indentations according to the invention.
Figure 1B:
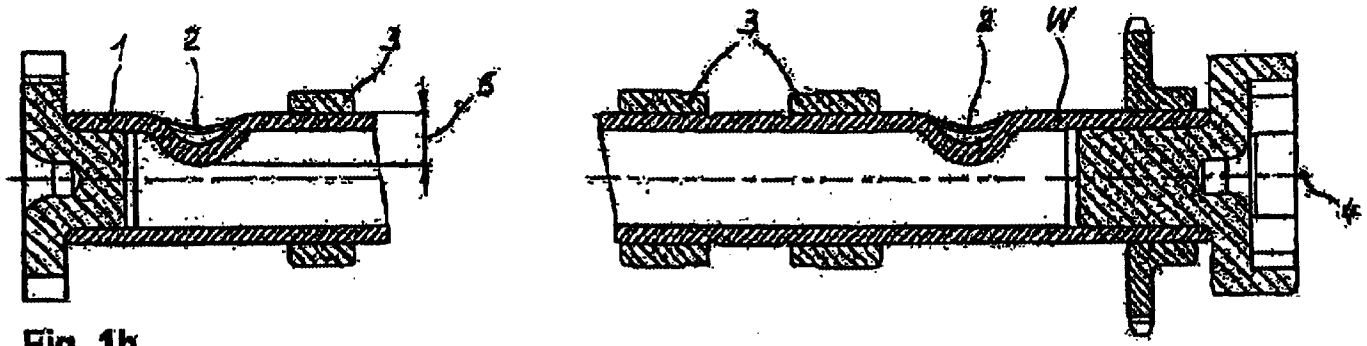
FIG. 1*b* is a schematic cross section of a tubular assembled camshaft with indentations according to the invention.
Figure 2:
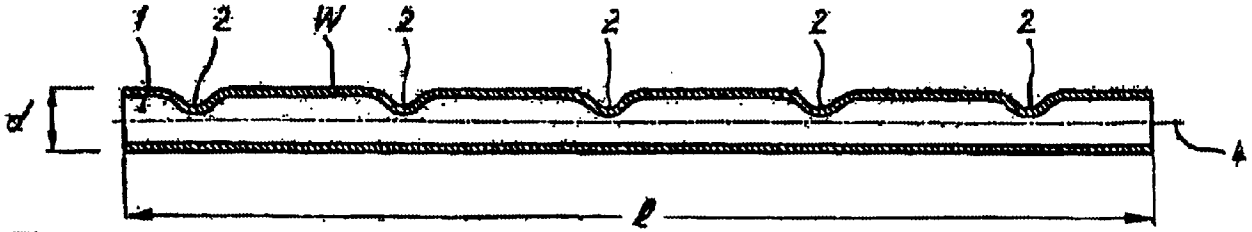
FIG. 2 is a schematic cross section of a tubular camshaft with several indentations pressed in according to the invention.

A so-called built-up camshaft such as one assembled from different parts, is depicted in side view in FIG. 1*a*. The camshaft comprises a camshaft tube 1 with length l, onto which cams 3 are slid, positioned and fastened, as well as additional elements for the bearing and driving of, for example, a drive gear wheel. In the installed state, the camshaft 1 is disposed such that it is supported bearing rotatably about its axis 4. Evident are also the indentations 2 according to the invention, which are disposed along the tube 1 corresponding to the desired position, where access to the cylinder head bolts in the installed state is required. With the increasingly narrower requirements of installation space in internal combustion engines, where such camshafts are provided, these indentations make possible access to the cylinder head bolts even after installation of the camshaft, if these indentations 2 are correspondingly formed and positioned with respect to the cylinder head bolts. If such camshafts are installed pairwise and are closely adjacent to one another, indentations 2 can be provided on both camshaft tubes 1, which are opposing one another and thus permit access to the cylinder head bolts if the shafts are rotated into correspondingly aligned positions. In FIG. 1*b* is depicted a camshaft configuration corresponding to FIG. 1*a* in longitudinal section. A camshaft tube 1 with several indentations 2 is depicted in FIG. 2. The indentation 2 is produced through lateral pressing into tube 1, with the indentation 2 being disposed transversely to the longitudinal axis 4 of the tube 1 and, compared to the original outer diameter d, is pressed in to a depth 6, which is pressed in by up to 40%, preferably up to 30%, of the outer tube diameter d. It is herein especially important that through the pressing operation the tube is not deformed such that a protrusion compared to the original outer tube diameter d, is generated. The camshaft structral components such as the cams 3 could otherwise no longer be slid over the indentations onto the tube into their position or enough tolerance would have to be provided such that the requisite precision would no longer be ensured.

Figure 3:
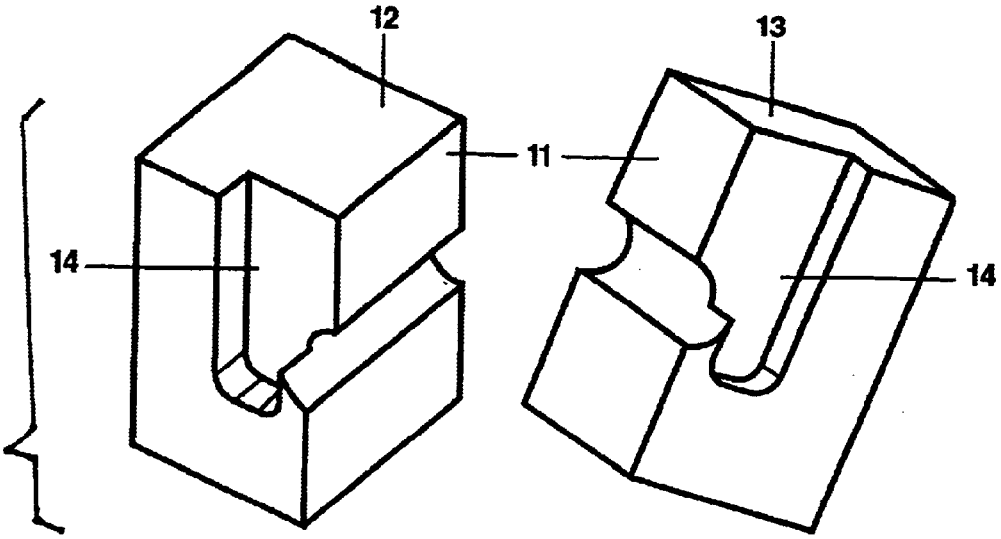
FIG. 3 is a schemptic three-dimensional view of a bottom die pair for receiving the camshaft tube.
Figure 4:
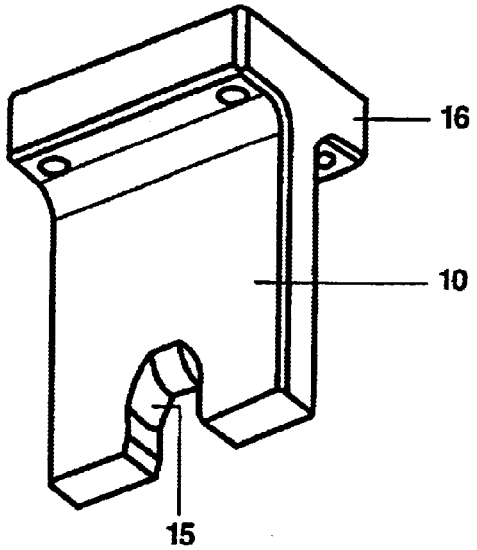
FIG. 4 is a schematic three-dimensional view of a pressing stamp.
Figure 5:
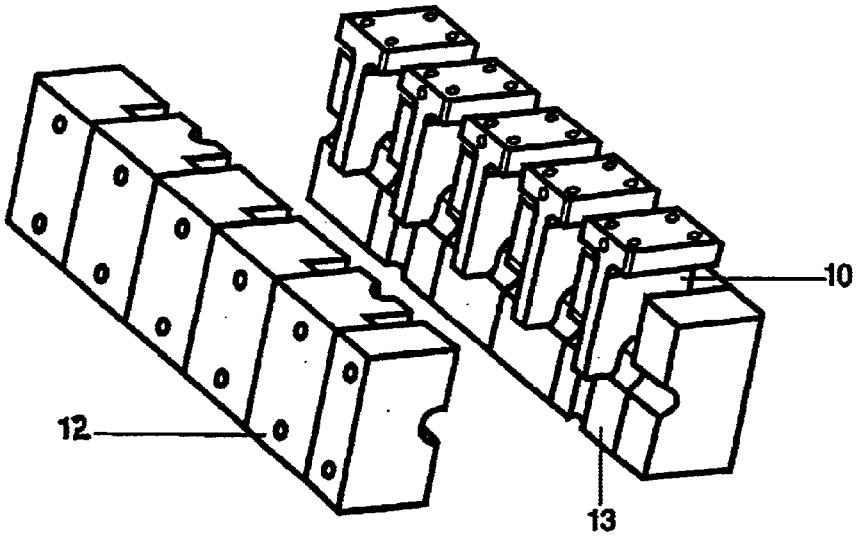
FIG. 5 is a schematic three-dimensional view a bottom die and stamp configuration for generating several indentations on a camshaft tube.

As stated, the pressing-in of indentations 2 is problematic due to the generated deformations and it must be ensured that tubes are not impermissibly deformed in the region of the outer diameter d or are pretensioned such that they have a residual bending after the pressing-in. Camshaft tubes, which are also suitable for pressing techniques, comprise a metal with steel ST52 preferably being employed and/or aluminum or their corresponding alloys. For retaining the tube for the pressing operation, a bottom die is utilized, which receives the tube such that it cannot be deformed in its outer diameter during the pressing operation beyond the outer diameter. In FIG. 3 a preferred bottom die 11 is depicted with a form-fitting recess for the tube. The bottom die 11 is preferably developed in two parts from a left bottom die part 12 and a right bottom die part 13, which can be separated along the tube axis 4 in order to facilitate thus the tube mounting or dismounting. In the bottom die parts 12, 13 is provided a track-form recess 14, in which a pressing stamp 10 is guided, such that the pressing stamp can be guided precisely laterally to the tube 1 in order to generate a pressing-in 2 corresponding to the formation of the stamp 10. The pressing stamp 10 has an outforming 15, which forms the stamp bottom and is developed according to the desired indentation form 2, as is shown in FIG. 4. On the opposing side of the stamp bottom 15 the stamp is developed as a stamp mounting 16, with which the stamp 10 can be fastened on the pressing machine. The recess 14 on bottom dies 12, 13 is advantageously developed to be open on one side on the bottom die parts 12, 13 at the front face, with which the configuration can be more readily mounted or dismounted and can be structured modularly. This is also of advantage primarily if, as shown in FIG. 5, several pressing tools are to be disposed serially one after the other in order to be able to generated several indentations 2. The pressing operation can herein be carried out simultaneously through several stamps 10 and bottom die pairs 12, 13 or can also be carried out sequentially one after the other. Furthermore, with this technique through further concatenation of the pressing tools 10, 12, 13 also several camshaft tubes 1 can be clamped in simultaneously along the axial direction 4 and thus can be worked simultaneously.

The bottom die 12, 13 is preferably not advanced in the same direction as stamp 10 but rather transversely to it in order to avoid burrs from being formed in the tool gap. The modular structure readily permits realizing in simple manner a different number of indentations 2 even at different spacings. The process operation herein takes place to advantage through a path-stop control. The present configuration makes it possible to reform even thick-walled tubes in simple manner. At the stated great depths 6 of indentations 2, which would also not be possible to realize, or would only be realizable with difficulty, in several working steps with the internal high-pressure reforming technique, also known as hydroforming. The method does not require an internal counterforce, the tensioning of the tube alone is herein sufficient. As stated, the bottom die 12, 13 should receive the tube 1 so as to be form-fitting in order to avoid outer tube deformations. The precision of the form-fit should be in the range of better than ±5% of the outer tube diameter d, and preferably a pretensioning should be set. The form of the stamp, as depicted in FIG. 4, should preferably be implemented as a shoe, which can be slid over the tube and which has a stamp bottom 15 whose form is adapted to the required indentation radius. For laying out these forms, the application of the finite element simulation calculation is helpful. Through the form-fitting retention of the tube with bottom die 11, in particular as pretensioning tool, it is achieved that the entire material displacement during the pressing operation takes place into the wall thickness w of tube 1 and the outer diameter d is not increased. Furthermore, in this method it is made possible that no intermediate step in the production, such as regrinding, overturning etc., between the introduction of the indentation and the mounting is required. This means high economy of the production process. Even stress-relieving of the tube, which is required under certain circumstances, hardly reduces the economy since this can be integrated as an automated step into the process sequence.

Figure 6:
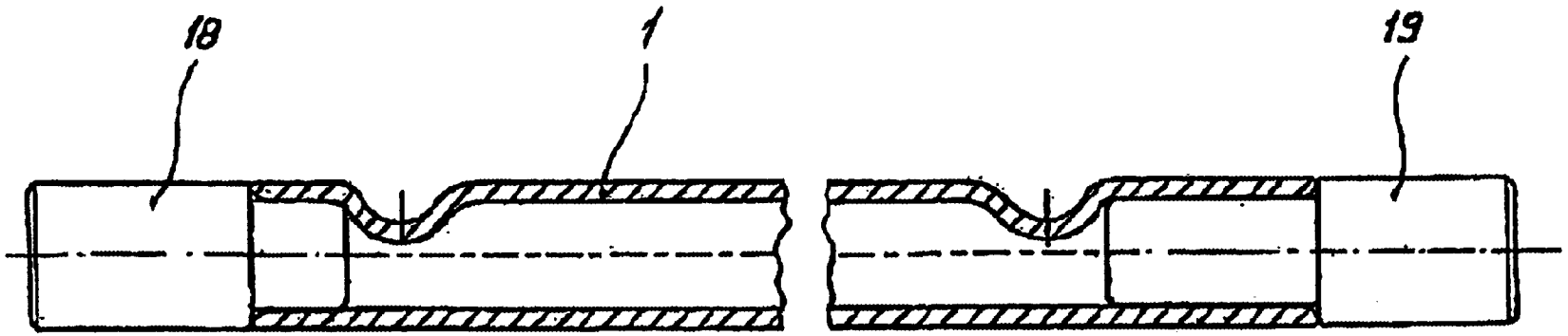
FIG. 6 is a schematic cross section of a tubular camshaft with indentations with auxiliary pins slid in at the end.

Apart from bottom dies 12, 13, during the pressing operation for the indentations 2 into the end regions of the tube 1 form-fitting auxiliary pins 18, 19 can be inserted in order to attain a supporting effect, as is shown in FIG. 6 by example. This measure prevents undesirable deformations from occurring in the end region of the tube, since the intrinsic support force of tube 1 in the end region is reduced without countermeasures. The dimensional accuracy is additionally improved with this approach. The precision can additionally be increased thereby that the insertion pin 18 on its front face has a decrease of the radius by at least 10%, which allows the auxiliary pin to be guided closer to the indentation 2 to be generated and therewith the stabilizing effect can be further increased.

What is claimed is:

1. A camshaft for an engine having cylinder head bolts, comprising a tube (1) onto which separately produced cams and/or bearings are positioned and fastened along the tube axis (4), the tube (1) having on a part of the circumference of the tube, a single external indentation (2) pressed transversely to the tube axis into inner and outer surfaces of a wall thickness of the tube at each axial location along the tube axis and not encircling the tube, the indentation being disposed along the tube (1) and beside the cams and/or bearings with no part of the indentation being covered by the cams and/or bearings and the indentation being sufficiently deep to allow access to the cylinder head bolts of the engine.

2. A camshaft as claimed in claim 1, wherein, in a region of deformation of the pressed-in indentation (2) the outer tube wall does not project beyond a predetermined original tube diameter (d).

3. A camshaft as claimed in claim 1, wherein several indentations (2) are provided on the tube (1) and are aligned in a longitudinal direction of the tube, parallel to the tube axis (4).

4. A camshaft as claimed in claim 1, wherein the indentation (2) has a depth (6) of up to 40% of the outer tube diameter (d) and the indentation (2) is disposed transversely to the axial direction (4).

5. A camshaft as claimed in claim 1, wherein the tube (1) comprises a metal.

6. A camshaft as claimed in claim 5, wherein the tube is steel St52 and/or aluminum or its alloys.

7. A camshaft for an engine having cylinder head bolts, comprising a tube (1) onto which separately formed cams and/or bearings, are positioned and fastened along the tube axis (4), the tube (1) having on a part of the circumference of the tube at least two external indentations (2) pressed transversely to the tube axis into inner and outer surfaces of a wall thickness of the tube on one side of the tube only and with a single indentation at each location along the tube axis, the at least two external indentations disposed longitudinally aligned along the side of the tube (1) and between the cams or bearings with no part of the indentations being covered by the cams and/or bearings, end the indentations each being sufficiently deep to allow access to the cylinder head bolts of the engine.

8. A camshaft according to claim 7, wherein each indentation (2) has a depth (6) of up to 40% of the outer tube diameter (d) and the indentation (2) is disposed transversely to the axial direction (4).

9. A camshaft as claimed in claim 7, wherein the tube (1) comprises a metal.

10. A camshaft as claimed in claim 9, wherein the tube is steel St52 and/or aluminum or its alloys.

11. A camshaft tube for an engine having cylinder head bolts, comprising a tube (1) onto which cams and/or bearings, are positioned and fastened along the tube axis (4), the tube (1) having external indentations (2) pressed transversely to the tube axis into inner and outer surfaces of a wall thickness of the tube and not encircling the tube and with a single indentation at each location along the tube axis, said indentations disposed along the tube (1) and beside the cams or bearings corresponding to a desired position where access to the cylinder head bolts in an installed state is required with no part of the indentations being covered by the cams and/or bearings and the indentations each being sufficiently deep to allow access to the cylinder head bolts of the engine.

12. A camshaft as claimed in claim 11, wherein said tube (1) does not bend during pressing of said indentations.

13. A camshaft as claimed in claim 11, wherein the indentations (2) have a depth (6) of up to 40% of the outer tube diameter (d) and the indentations (2) are disposed transversely to the axial direction (4).

14. A camshaft as claimed in claim 11, wherein, in a region of deformation of the pressed-in indentation (2) the outer tube wall does not project beyond a predetermined original tube diameter (d).

15. A camshaft claimed in claim 11, wherein several indentations (2) are provided on the tube (1) and are aligned in a longitudinal direction of the tube, parallel to the tube axis (4).

16. A camshaft as claimed in claim 11, wherein the tube (1) comprises a metal.

17. A camshaft as claimed in claim 16, wherein the tube is steel St52 and/or aluminum or its alloys.

* * * * *